US007152557B2

(12) United States Patent
Forbush

(10) Patent No.: US 7,152,557 B2
(45) Date of Patent: Dec. 26, 2006

(54) APPARATUS FOR ADJUSTING AN OPERATIONAL POINT OF AN ENGINE

(75) Inventor: Lawrence B. Forbush, Harrisville, UT (US)

(73) Assignee: Amalgamated Performance Enhancements, L.L.C., Las Vegas, NV (US)

( * ) Notice: Subject to any disclaimer, the term of this patent is extended or adjusted under 35 U.S.C. 154(b) by 39 days.

(21) Appl. No.: 10/640,261

(22) Filed: Aug. 14, 2003

(65) Prior Publication Data

US 2004/0031453 A1 Feb. 19, 2004

(51) Int. Cl.
*F02B 75/02* (2006.01)

(52) U.S. Cl. ..... 123/65 PE; 137/524

(58) Field of Classification Search ..... 123/65 PE, 123/65 P, 323; 137/524, 375
See application file for complete search history.

(56) References Cited

U.S. PATENT DOCUMENTS 3,985,141 A * 10/1976 Stanley et al. ..... 128/207.15
4,195,552 A * 4/1980 Neff ..... 91/443
4,303,063 A * 12/1981 Stahl ..... 601/37
4,399,788 A 8/1983 Bostelmann
4,516,599 A * 5/1985 Nakaya et al. ..... 137/375
4,736,083 A * 4/1988 Saville ..... 219/686
6,189,494 B1 * 2/2001 Nagumo et al. ..... 123/65 PE
6,244,227 B1 6/2001 Matte
6,418,890 B1 * 7/2002 Dopona ..... 123/65 PE

OTHER PUBLICATIONS

Piero Zambotti: "SG Tech, Power Valve Maintenance," Dec. 2000, http://www.snowgoercanada.com/tech_valve.shtml, pp. 1-3.
"Carb's FAQ," http://fishbug1.freeyellow.com/page6.html, Mar. 2000, pp. 1-4.
Mark Austin: "Snowmobile Online, R.A.V.E. Maintenance," Apr. 2000, http://www.off-road.com/snowmobile/info/howto/2000/apr/rave/rave.html, pp. 1-4.

* cited by examiner

*Primary Examiner*—Stephen K. Cronin
*Assistant Examiner*—Hyder Ali
(74) *Attorney, Agent, or Firm*—Harrity Snyder, LLP

(57) ABSTRACT

An exhaust valve assembly may include a diaphragm connected to a restricting member. The diaphragm may be configured to change a position of the restricting member based on a pressure on a first side of the diaphragm. A spring may abut a second side of the diaphragm opposite the first side. The spring may apply a force to the second side of the diaphragm. An adjustable portion adjacent the spring may be configured to change the force applied to the diaphragm by the spring.

25 Claims, 5 Drawing Sheets

APPARATUS FOR ADJUSTING AN OPERATIONAL POINT OF AN ENGINE

BACKGROUND OF THE INVENTION

1. Field of the Invention

This invention relates to combustion engines and, more particularly, to exhaust valves in combustion engines.

2. Description of Related Art

Manufacturers of combustion engines in motorized conveyances may make a number of performance-related choices when designing their engines. Such manufacturers, because they seek to sell the conveyances to a relatively broad market, may make design trade-offs and choices to satisfy the most users over the widest range of possible conditions. Most users may find that these "middle of the road" design trade-offs and choices result in acceptable engine performance for their needs.

Some users, however, may wish to modify their engines from an original or "stock" configuration to obtain better performance, such as overall performance or performance under certain environmental conditions. Such "performance tuning" may be performed in a mechanic's and/or the user's shop/garage and may involve wholesale replacement or modification of at least a portion of the engine. In certain situations (e.g., for changing environmental conditions and/or for performance tweaking), however, users may wish to tune their engines relatively rapidly during a short break when using the conveyance (e.g., "on the fly"). In such situations, various tools and/or parts may be required to make the change(s) to improve performance. This requirement for tools and/or parts makes on the fly changes impractical for most users.

Thus, there is a need in the art for devices to facilitate the rapid user-tuning of engines.

SUMMARY OF THE INVENTION

Systems and processes consistent with the principles of the invention may include, among other things, a hand-adjustable mechanism for rapidly changing a biasing force on a restricting member within an engine.

In accordance with one purpose of the invention as embodied and broadly described herein, an adjustable cap for an exhaust valve assembly may include a stationary portion configured to connect to the exhaust valve assembly. The stationary portion may include a top. The adjustable cap may also include a moveable portion moveably connected to the stationary portion. The moveable portion may be configured to receive one end of a spring. The moveable portion may also protrude from the top of the stationary portion and may be configured to change a length of the spring when moved.

In another implementation consistent with principles of the invention, an adjustable cap for an exhaust valve assembly may include a base configured to connect to the exhaust valve assembly. The adjustable cap may also include a knob rotatably connected to the base. The knob may be configured to receive one end of a spring and change a compression of the spring among a number of different compressions. At least one of the base and the knob may include a number of positional marks. The knob is configured to change the compression of the spring among the number of different compressions when rotated among the number of positional marks.

In a further implementation consistent with principles of the invention, an exhaust valve assembly may include a diaphragm connected to a restricting member and configured to change a position of the restricting member based on a pressure on a first side of the diaphragm. A spring may abut a second side of the diaphragm opposite the first side and may apply a force to the second side of the diaphragm. An adjustable portion adjacent the spring may be configured to change the force applied to the diaphragm by the spring.

In a yet another implementation consistent with principles of the invention, an engine may include a cylinder structure including an inside wall that defines a cylinder bore with an exhaust port. The engine may also include a piston that is movable in the cylinder bore and is adapted to open and close the exhaust port. A restricting member may be mounted in the cylinder structure adjacent the exhaust port. The restricting member may be adjustable between a more restricting position that decreases an area of the exhaust port and a less restricting position that increases an area of the exhaust port. An assembly may be configured to move the restricting member between the more restricting position and the less restricting position. The assembly may be externally adjustable by hand to vary a biasing force on the restricting member.

BRIEF DESCRIPTION OF THE DRAWINGS

The accompanying drawings, which are incorporated in and constitute a part of this specification, illustrate an embodiment of the invention and, together with the description, explain the invention. In the drawings.

DETAILED DESCRIPTION

The following detailed description of the invention refers to the accompanying drawings. The same reference numbers may be used in different drawings to identify the same or similar elements. Also, the following detailed description does not limit the invention. Instead, the scope of the invention is defined by the appended claims and equivalents.

As described herein, in one implementation consistent with the principles of the invention, a hand-adjustable mechanism may facilitate rapidly changing a biasing force on a restricting member within an engine. The mechanism may include indicia for visual feedback during the adjustment.

Exemplary System

Figure 1:
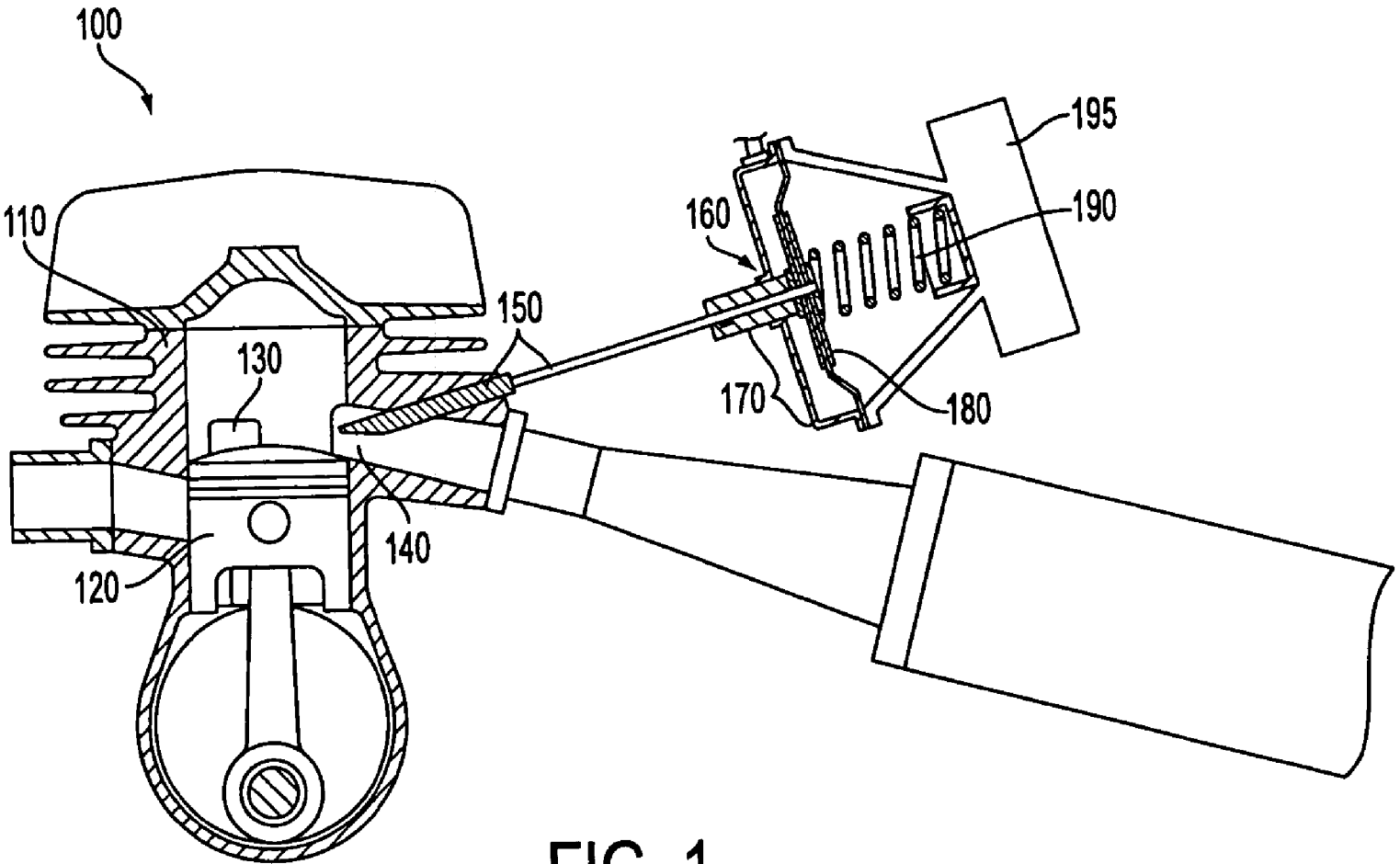
FIG. 1 is a sectional view of an internal combustion engine according to an implementation consistent with the principles of the invention.

FIG. 1 is a sectional view of an internal combustion engine 100 according to an implementation consistent with the principles of the invention. In some implementations, engine 100 may be a "two-stroke engine" including at least one cylinder (e.g., a one, two, three or more cylinder engine). In one implementation consistent with the principles of the invention, engine 100 may include a two cylinder, two-stroke engine, although only one cylinder is illustrated in FIG. 1 for clarity of presentation. Engine 100 may be included in a snowmobile, motorcycle, watercraft, aircraft, or other suitable motorized conveyance.

Engine 100 may include a cylinder 110, a piston 120, an inlet port 130, an exhaust port 140, a restricting member 150, and a valve assembly 160. Valve assembly 160 may include a casing 170, a diaphragm 180, a spring 190, and an adjustable cap 195.

As is understood in the art, cylinder 110 is configured to house combustion and facilitate reciprocating movement of piston 120. Inlet port 130 may be configured to admit air or an air/fuel mixture into cylinder 110 at appropriate times before combustion in a two-stroke combustion cycle.

Exhaust port 140 may be configured to allow the escape of expanding gasses at appropriate times after combustion in a two-stroke combustion cycle. Exhaust port 140 may be opened to allow the expanding gasses to escape by the movement of piston 120 after combustion occurs.

Restricting member 150 may be arranged to move along its axis between an extended position and a retracted position. In the extended position, as illustrated in FIG. 1, restricting member 150 may reduce a cross-sectional area of exhaust port 140 available for the expanding gasses to escape. Further, in the extended position, restricting member 150 may delay a time at which gasses may escape by movement of piston 120. That is, with restricting member 150 in the extended position, the top of piston 120 may take slightly longer on its downward stroke to reach the effective top/beginning of exhaust port 140 (i.e., the tip of restricting member 150). By contrast, in the retracted position, restricting member 150 may not significantly affect, or may less significantly affect, the cross-sectional area of exhaust port 140. Restricting member 150 may be moved between the extended position and the retracted position by valve assembly 160. Further details of restricting member 150 and other portions of engine 100 would be understood by those of ordinary skill in the art and are described, for example, in U.S. Pat. Nos. 4,399,788 and 6,244,227, which are incorporated herein by reference. It should be understood that other schemes for restricting the cross-sectional area of an exhaust port may be used in implementation consistent with the principles of the invention, and that the apparatus shown in FIG. 1 is exemplary only.

Valve assembly 160 may include casing 170 to hold restricting member 150 and diaphragm 180. Casing 170 may permit sliding movement of restricting member 150, while positioning restricting member 150 in a fixed orientation relative to exhaust port 140. Diaphragm 180 may fixedly connect to one end of restricting member 150, via, for example, a receiving member that fits within diaphragm 180 and is configured to receive and hold the end of restricting member 150.

Diaphragm 180 may be configured to slidably move restricting member 150 between its extended and retracted positions. Casing 170 (and possibly restricting member 150) may be arranged to admit pressurized gas from cylinder 110 and/or exhaust port 140 via one or more openings (not shown) to act on diaphragm 180. Diaphragm 180 may move between two positions (thereby moving the attached restricting member 150) depending on an amount of pressure on the side opposite spring 190. In this sense, diaphragm 180 may be considered a "bistable" device, because it may move between stable first and second positions, where its center (that is attached to the end of restricting member 150) may be different distances from exhaust port 140. FIG. 1 illustrates diaphragm 180 in the first position (i.e., closer to exhaust port 140) and the attached restricting member 150 in the extended position, where it partially occludes exhaust port 140.

Spring 190 may provide a biasing force to one side of diaphragm 180 to counteract any pressure on the opposite side of diaphragm 180. In the absence of pressure on diaphragm 180 (or in the presence of relatively low pressure), spring 190 is expanded and acts to "bias" diaphragm 180 toward exhaust port 140 so that restricting member 150 is in the extended position. When sufficient pressure exists on diaphragm 180 to overcome the force of spring 190, spring 190 is compressed, and diaphragm 180 moves away from exhaust port 140 so that restricting member 150 is in the retracted position. For example, at low revolutions per minute (RPMs) engine 100 may not generate enough pressure on diaphragm 180 to overcome the biasing force of spring 190, and restricting member 150 may remain extended to restrict exhaust port 140. At higher RPMs, however, engine 100 may generate enough pressure on diaphragm 180 to overcome the biasing force of spring 190. Diaphragm 180 may move to compress spring 190 and retract restricting member 150 to open exhaust port 140.

Spring 190 may exert one force (e.g., 4.7 lbs.) in its "expanded position" (e.g., a 1.0 inch length) and may exert another force (e.g., 7.1 lbs.) in its "compressed position" (e.g., a 0.63 inch length). It should be noted that as used herein, "expanded" and "compressed" are terms of degree, and do not denote absolute positions. For example, spring 190 may be somewhat compressed from its uncompressed "free length" (e.g., 1.734 inches) when in its "expanded" position (e.g., a 1.0 inch length) within valve assembly 160. The values given herein for spring lengths and corresponding forces are purely exemplary, and do not limit the principles of the invention described herein. The forces exerted by any particular spring 190 at its expanded and compressed positions may depend on, for example, the diameter, materials, shape, etc. of the material used in spring 190.

Adjustable cap 195 may be configured to hold one end of spring 190, with the other end of spring 190 abutting diaphragm 180. Adjustable cap 195 may include an adjustment mechanism for varying the compression of spring 190. For example, the adjustment mechanism in adjustable cap 195 may vary the length of spring 190 at its expanded position among a number of different expanded lengths. The length of spring 190 at its compressed position may also change among a corresponding number of different compressed lengths. Examples of adjustable cap 195 will be described in FIGS. 2A to 4C, but the principles of the invention described herein are not limited to the specific details in these examples.

In one implementation consistent with the principles of the invention, adjustable cap 195 may include a stationary portion and a movable portion. FIGS. 2A–2D illustrate top, side, and cross-sectional views of a stationary portion 200 of adjustable cap 195. Stationary portion 200 may include a base 210, a neck 220, and a top 230. In one implementation consistent with the principles of the invention, base 210, neck 220, and top 230 may be unitarily formed from a single piece of metal, such as aluminum. Alternately, base 210, neck 220, and top 230 may be formed of separate pieces that may be connected to each other.

Base 210 may be configured to abut casing 170 and securely hold diaphragm 180 therebetween. In the implementation shown in FIG. 2A, base 210 may include a number of holes 212 in its perimeter to facilitate attachment to casing 170 via screws or bolts. In another implementation (not shown), base 210 may be configured to attach to casing 170 of valve assembly 160 via a retaining clip that is attached to casing 170 and may snap-fit over base 210. As illustrated in FIG. 2C, which is taken along line 2C in FIG. 2A, base 210 may narrow from the portion that abuts casing 170 and diaphragm 180 to neck 220.

Neck 220 may be roughly cylindrical and may protrude upward from base 210. Neck 220 may have an inner surface and an outer surface. The inner surface of neck 220 may include screw-type threads 240 configured to receive the moving portion of cap 195 that is described in further detail below with respect to FIGS. 3A to 4C. In one implementation consistent with the principles of the invention, threads 240 may be fairly "fast." That is, threads 240 may be configured to produce a relatively large vertical displacement of the moving portion of cap 195 over a relatively small amount of radial movement (e.g., about one revolution or less).

Figure 2B:
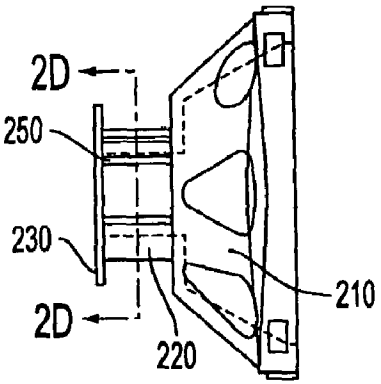
FIGS. 2A and 2B illustrate top and side views of an adjustable cap in the engine of FIG. 1.
Figure 2D:
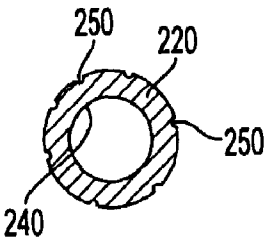
FIGS. 2C and 2D illustrate cross-sectional views of the adjustable cap in FIGS. 2A and 2B.

The outer surface of neck 220 may include, in some implementations, a number of longitudinal grooves 250 as illustrated in FIG. 2B and FIG. 2D. FIG. 2D is taken along line 2D in FIG. 2B. Grooves 250 may facilitate setting the moving portion of adjustable cap 195 at a number of discrete positions. In one implementation consistent with the principles of the invention, neck 220 may include seven grooves, at least six of which are spaced apart by about 56 degrees. Other numbers and angular separations are possible for grooves 250, but the specific arrangement described above may facilitate seven discrete positions for the moving portion of adjustable cap 195.

Top 230 may flare outward slightly from the upper portion of neck 220, as illustrated in FIG. 2C. Top 230 may include indicia 235 on its upper surface that may be applied to, etched into, or otherwise incorporated into the material of top 230. Indicia 235 on top 230 may include numbers, letters, symbols, or other non-alphanumeric characters. The location and spacing of indicia 235 may be related to the locations of grooves 250.

Figure 2A:
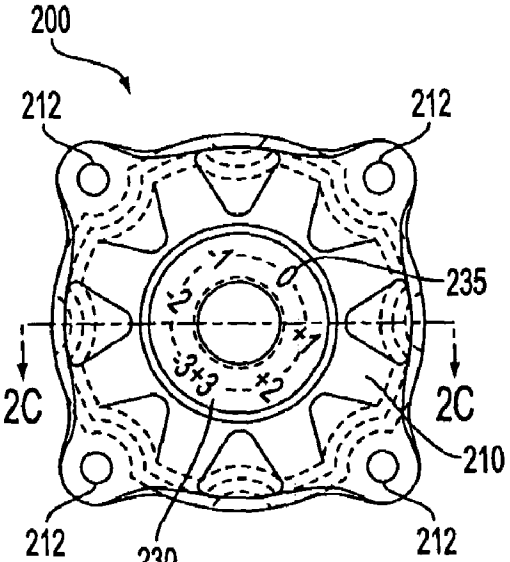
Figure 2C:
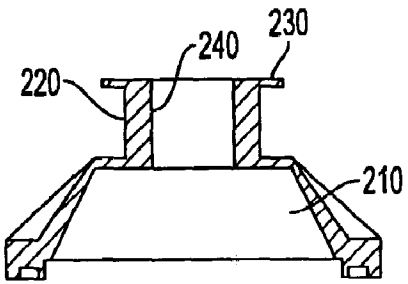

In one implementation consistent with the principles of the invention, as shown in FIG. 2A, indicia 235 on top 230 may include an integer numerical scale ranging from −3 to +3. In one implementation, the characters of indicia 235 may be located radially opposite (i.e., 180 degrees away) from corresponding grooves 250 on neck 220. Other implementations are possible, however, such as radial co-location (i.e., 0 degree difference) between the characters of indicia 235 and corresponding grooves 250. Of course, other configurations are possible for indicia 235 on top 230, such as a scale that does not have a central position (i.e., the "0" position in FIG. 2A).

Figure 3B:
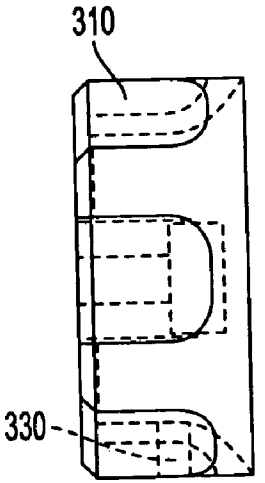
FIGS. 3A to 3C illustrate top, side, and cross-sectional views of a movable portion of an adjustable cap according to one implementation consistent with the principles of the invention.
Figure 3A:
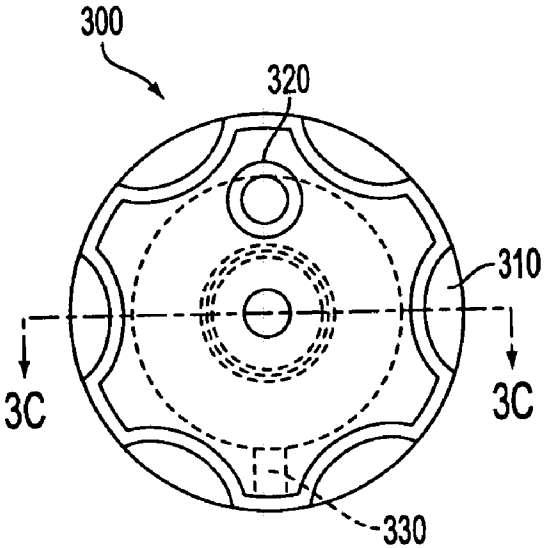
Figure 3C:
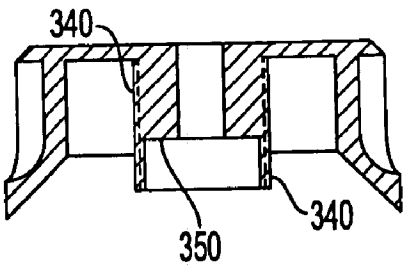

FIGS. 3A to 3C illustrate top, side, and cross-sectional views of a movable portion 300 of adjustable cap 195 that may be used with stationary portion 200 according to one implementation consistent with the principles of the invention. Movable portion 300 may be generally shaped like a circular dial and may include indentations 310, a window 320, an adjustment hole 330 (including a set screw), a threaded surface 340, and a cup 350 for retaining one end of spring 190.

Indentations 310 in movable portion 300 may facilitate gripping and turning movable portion 300 by hand. Because of the round, roughly textured surface that indentations 310 provide, moveable portion 300 may be gripped and turned even by a user wearing thick gloves, such as ski gloves or mittens. Window 320 may permit viewing of a character of indicia 235 on top 230 of stationary portion 200. The dotted line in FIG. 3A illustrates the circumference of top 230 in relation to window 320 of moveable portion 300. By dialing moveable portion 300 until a certain character of indicia 235 (e.g., −1, 0, +1, +2, etc.) on top 230 appears in window 320, moveable portion 300 may be adjusted to a precise rotational position relative to stationary portion 200 in a repeatable manner.

Adjustment hole 330 may be configured to accept an adjustment mechanism such as a set screw. Such a set screw in adjustment hole 330 may settle into one of grooves 250 on neck 220 and hold moveable portion 300 of cap 195 in one of a number of precise rotational positions relative to stationary portion 200. In one implementation consistent with the principles of the invention, adjustment hole 330 may be located radially opposite window 320 so that when a character of indicia 235 on top 230 appears in window 320, the adjustment mechanism (e.g., set screw) in adjustment hole 330 is aligned with a groove 250 on neck 220. Other relative orientations between adjustment hole 330 and window 320 are possible that align a character of indicia 235 with window 320 when adjustment hole 330 is aligned with one of grooves 250.

Threaded surface 340 may be configured to fit within and interoperate with threads 240 on the inner surface of neck 220 to move movable portion 300 up and down relative to stationary portion 200 of cap 195. Cup 350 may be configured to retain one end of spring 190, the other end of spring 190 resting on diaphragm 180. Due to the movement of threaded surface 340 of movable portion 300 relative to threads 240 of stationary portion 200, the end surface of cup 350 abutting spring 190 may move to change the length of spring 190 (e.g., in its expanded position). For example, approximately one revolution of moveable portion 300 relative to stationary portion 200 may move the bottom of cup 350, and thus change the length of spring 190, by about 0.2 to 0.3 inches total. Higher and lower length changes for spring 190 are possible by, for example, modifying the height of neck 220 and/or the slope of threads 240 on neck 220.

In operation, moveable portion 300 of cap 195 may adjust spring 190 to a number of different heights, thereby imparting a number of different forces on diaphragm 180. In one illustrative example, spring 190 may be constructed of 0.046 inch diameter wire. When moveable portion 300 of cap 195 is in a central position (i.e., the "0" position in FIG. 2A) relative to stationary portion 200, spring 190 may be in a nominal position and may exert a biasing force of about 4.7 lbs. on diaphragm 180. When moveable portion 300 of cap 195 is successively lowered from its central position (i.e., the "+1," "+2," and "+3," positions in FIG. 2A), spring 190 may be successively compressed relative to its nominal position and may successively exert higher biasing forces of about 5.5 lbs., 6.3 lbs., and 7.5 lbs. on diaphragm 180. In general, the more spring 190 is compressed, the greater the force it exerts on diaphragm 180. Conversely, when moveable portion 300 of cap 195 is successively raised from its central position (i.e., the "−1," "−2," and "−3," positions in FIG. 2A), spring 190 may be successively expanded relative to its nominal position and may successively exert lower biasing forces of about 4.0 lbs., 3.1 lbs., and 3.0 lbs. on diaphragm 180. The number of adjustment positions of moveable portion 300 may range from about three to about twenty or more. For example, the number of adjustment positions may range between about five and about ten.

In this manner, adjustable cap 195 may allow a single spring 190 to be used to achieve a number of different operating points for engine 100 instead of a number (i.e., seven in the above example) of different-weight springs 190 that might be needed if a non-adjustable cap were present. The shape and external location of moveable portion 300 relative to valve assembly 160 may facilitate rapid adjustment of engine 100 by hand. Further, indicia 235 and/or grooves 250 on stationary portion 200 may facilitate the precise and repeatable adjustment of engine 100 among a number of different operating points.

Figure 4B:
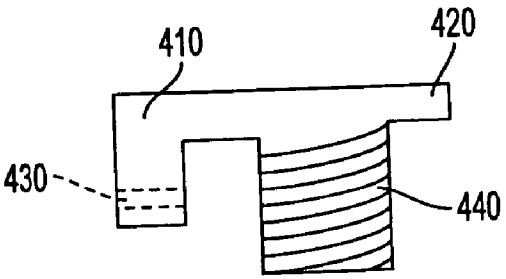
FIGS. 4A to 4C illustrate top, side, and cross-sectional views of another movable portion of an adjustable cap according to another implementation consistent with the principles of the invention.
Figure 4A:
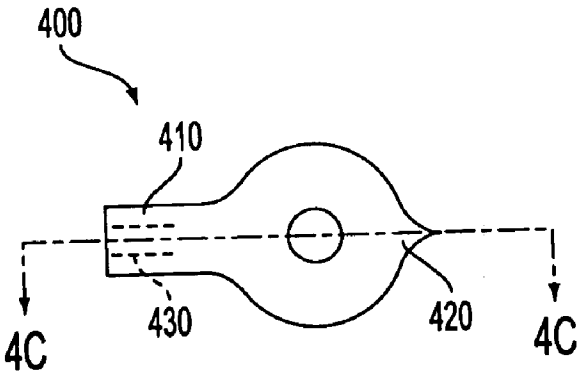
Figure 4C:
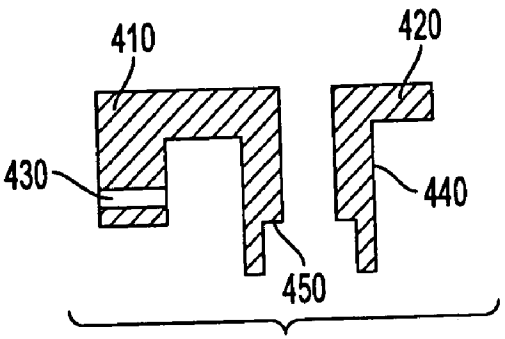

FIGS. 4A to 4C illustrate top, side, and cross-sectional views of another movable portion 400 of adjustable cap 195 that may be used with stationary portion 200 according to another implementation consistent with the principles of the invention. Movable portion 400 may be generally shaped like an arrow and may include a handle 410, a pointer 420, an adjustment hole 430 (including a set screw), a threaded surface 440, and a cup 450 for retaining one end of spring 190. Adjustment hole 430, threaded surface 440, and cup 450 are configured to operate in a manner similar to previously-described adjustment hole 330, threaded surface 340, and cup 350. Therefore, further description of these elements of moveable portion 400 will not be repeated.

Handle 410 of movable portion 400 may facilitate gripping and turning movable portion 400 by hand. Because handle 410 may radially protrude beyond neck 220 of stationary portion 200 of cap 195, moveable portion 400 may be gripped and turned even by a user wearing thick gloves, such as ski gloves or mittens. The tip of pointer 420 may designate a particular character of indicia 235 on top 230 of stationary portion 200.

In contrast to moveable portion 300, where only one character of indicia 235 is visible through window 320, the circular area of moveable portion 400 may lie inside indicia 235 as illustrated in FIG. 2A, so that only a single character may be obscured by handle 410. In other words, moveable portion 400 permits viewing of indicia 235 other than the particular character being pointed to by pointer 420. The dotted line in FIG. 4A illustrates the circumference of top 230 in relation to pointer 420 of moveable portion 400. By turning moveable portion 400 until a certain character of indicia 235 (e.g., −1, 0, +1, +2, etc.) on top 230 is adjacent pointer 420, moveable portion 400 may be adjusted to a precise rotational position (and hence length/force of spring 190 via vertical movement of cup 450) relative to stationary portion 200 in a repeatable manner.

Consistent with the principles of the invention, other moveable and stationary portions of adjustable cap 195 than portions 200/300/400 may be designed that adjust the length of spring 190 in a number of discrete increments, which may be greater or fewer than the seven increments described above. For example, mechanisms other than screw-type threads may be employed to raise and lower an adjustable portion of cap 195 relative to a stationary portion. Cap 195 also may not necessarily include a moveable portion. For example, cap 195 may include a slot through which the height of spring 190 may be adjusted. Inserting different-thickness discs to abut spring 190 may be one possible scheme, or some type of ratcheting mechanism may be employed to adjust the height of spring 190. In such cases, however, some type of indicia on cap 195 may be useful to provide visual information to a user about the relative position of spring 190.

Exemplary Operation

Engine 100 and valve assembly 160 may be located in a snowmobile in one exemplary implementation consistent with the principles of the invention. In such an implementation, it may be desirable to use a "heavier" spring 190 at higher elevations where the air is less dense (i.e., "thinner"), so that the cross-sectional area of exhaust port 140 is smaller (e.g., restricted more often by restricting member 150) for the thinner air. Similarly, it may be desirable to use a "lighter" spring 190 at lower elevations where the air is more dense (i.e., "thicker/heavier"), so that the cross-sectional area of exhaust port 140 is larger (e.g., restricted less often by restricting member 150) for the heavier air.

In such an implementation, the central setting (i.e., the "0" position) of moveable portion 300/400 of adjustable cap 195 may correspond to a standard/stock force that is specified by the manufacturer of engine 100 to be produced by spring 190 on diaphragm 180. Such a spring force may be, for example, about 4.7 lbs. when spring 190 is in an expanded position and may be about 7.1 lbs. when spring 190 is in a compressed position due to exhaust pressure moving diaphragm 180. This central setting (i.e., "0" position) of cap 195 may produce optimal performance of engine 100 at a certain altitude, such as 7000 feet above sea level.

If the snowmobile is at a different altitude, however, different settings of adjustable cap 195 may produce optimal performance of engine 100. For example, at 8500 feet, cap 195 may be adjusted to a higher setting (i.e., the "+1" position) that compresses spring 190 and produces a higher force on diaphragm 180. At further increases of altitude of 1000 or 1500 feet, cap 195 may be further adjusted to higher-force settings (i.e., the "+2" and "+3" positions) that further compress spring 190 and produce still higher forces on diaphragm 180. At lower elevations (e.g., below about 6500 feet), cap 195 may be adjusted to lower-force settings (i.e., the "−1," "−2," and "−3" positions) that expand spring 190 relative to its standard/stock position and produce lower forces on diaphragm 180.

In this manner, adjustable cap 195 may be used to rapidly adjust performance of engine 100 when altitude changes, for example, during the course of a snowmobile ride or race. In practice, all a user need do is access valve assembly 160 (e.g., by opening the cover of an idling engine 100) and quickly hand-adjust moveable portion 300/400 of cap 195 in accordance with a current or anticipated altitude. If engine 100 has two cylinders 110 (and hence two valve assemblies 160), adjustable caps 195 of both assemblies 160 may be adjusted to the same setting (e.g., both set at the "+1" position). The different settings of cap(s) 195 and spring(s) 190 may not vary linearly with altitude, but may be sufficient to optimize performance of engine 100 over a range of altitudes, such as 4,500 to 10,500 feet and higher.

Although the above exemplary use of engine 100 including adjustable cap 195 is in a snowmobile, engine 100 and adjustable cap 195 may be employed in other conveyances, such as motorcycles or watercraft or aircraft consistent with the principles of the invention. In such conveyances, the performance of engine 100 may not be adjusted for altitude, but instead may be optimized via adjustable cap(s) 195 for some other environmental factor (e.g., air temperature) and/or performance parameter or parameters. For example, cap(s) 195 may be adjusted (perhaps experimentally in conjunction with a number of test runs in the conveyance) for 1) top speed, 2) maximum acceleration, or 3) some combination of these. It is specifically contemplated that adjustable cap 195 as described herein or its equivalents may be used for performance-tuning engines 100 in a wide variety of motorized conveyances.

Exemplary Process

Figure 5:
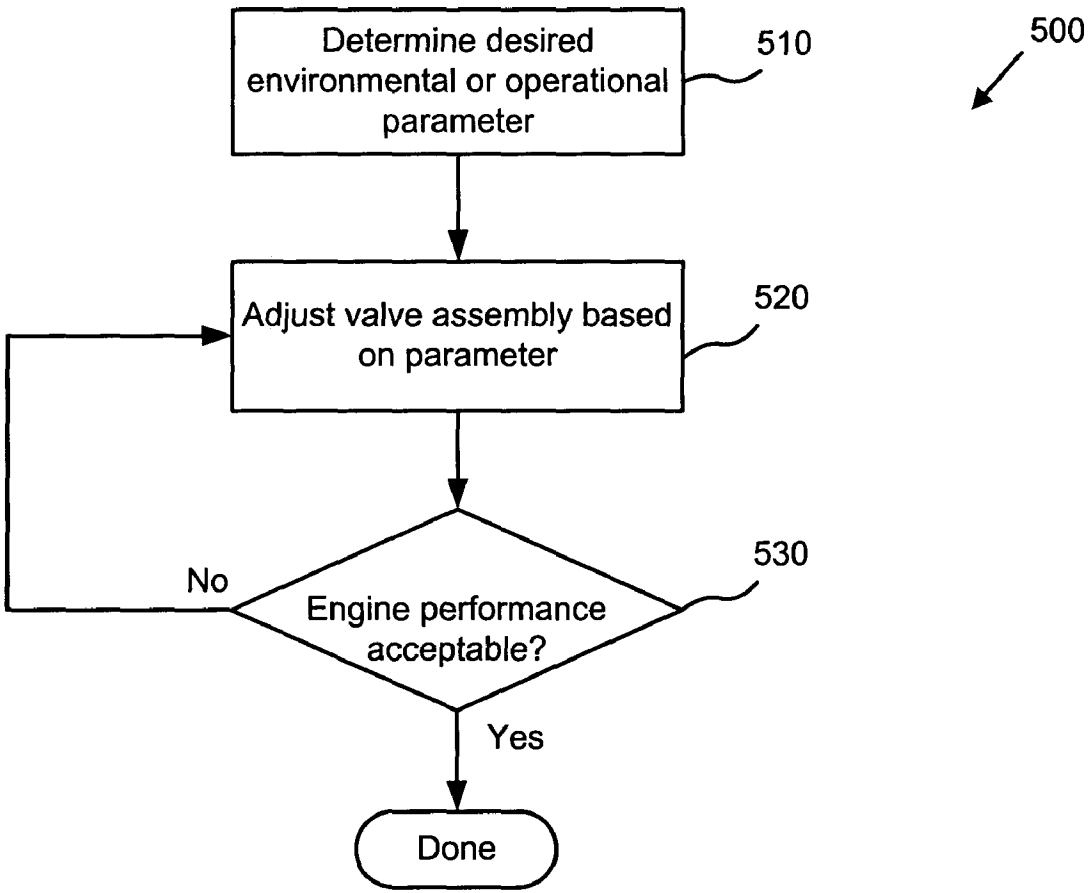
FIG. 5 is flow chart illustrating a process of tuning the performance of an engine according to an implementation consistent with the present invention.

FIG. 5 is flow chart illustrating a process 500 of tuning the performance of an engine according to an implementation consistent with the present invention. Process 500 may begin with a user determining a desired environmental or operational parameter for engine 100 [act 510]. As described above, one such parameter may be an elevation at which engine 100 is desired to operate optimally. Other parameters may include speed, power, and/or torque of engine 100. The user of engine 100 (e.g., the operator of a snowmobile, watercraft, motorcycle, etc.) may either have some a priori knowledge of the parameter (e.g., that he is/will be at about 7000 feet elevation) or may just know the direction in which he wants the parameter to move (e.g., greater low-end power).

Process 500 may continue with the user adjusting value assembly 160 based on the desired parameter [act 520]. For example, the user may set adjustable cap 195 to one of a number of values (e.g., positions −3 to +3) based on a known or estimated altitude of engine 100 as described above. In another case, the user may adjust the force/length of spring 190 to produce a known result, such as opening/narrowing exhaust port 140, based on a desired performance parameter such as acceleration.

The user may determine whether the adjustment in act 520 produced acceptable performance from engine 100 [act 530]. If the user is not satisfied with the performance of engine 100, act 520 may be repeated one or more times. If the user is satisfied, however, process 500 is complete.

CONCLUSION

Systems and methods consistent with the principles of the invention may facilitate rapidly changing a biasing force on a restricting member within an engine. The systems may include indicia for visual feedback during the adjustment. The foregoing description of preferred embodiments of the present invention provides illustration and description, but is not intended to be exhaustive or to limit the invention to the precise form disclosed. Modifications and variations are possible in light of the above teachings or may be acquired from practice of the invention.

For example, although a number of discrete positions have been described for moveable portion 300/400 of cap 195, these portions may instead be continuously adjustable. In such an implementation, stationary portion 200 may not include grooves 250, but at least some part of cap 195 should be operable to fix moveable portion 300/400 in a desired position. Also, indicia 235 need not be affixed to stationary portion 200, but may be present elsewhere. Moreover, other (perhaps non-rotational) mechanical schemes are specifically contemplated to accomplish the result of adjusting the compression of spring 190 in assembly 160.

Further, electromechanical and/or electrical actuators may also be used to adjust compression of spring 190 in implementations consistent with the principles of the invention. For example, various electrical/electronic controls may be used to sense various operational/environmental parameters and automatically adjust the compression of spring 190 and/or adjust the cross-section size of exhaust port 140.

Moreover, the acts in FIG. 5 need not be implemented in the order shown; nor do all of the acts need to be performed. Also, those acts which are not dependent on other acts may be performed in parallel.

No element, act, or instruction used in the description of the present application should be construed as critical or essential to the invention unless explicitly described as such. Also, as used herein, the article "a" is intended to include one or more items. Where only one item is intended, the term "one" or similar language is used. Also, as used herein, the term "hand-adjustable" is intended to mean adjustable solely by hand, without using a tool or other instrumentality, such as a screwdriver, wrench, coin, etc. The scope of the invention is defined by the claims and their equivalents.

What is claimed:

1. An adjustable cap for controlling the size of an exhaust port of an exhaust valve assembly of an internal combustion engine, comprising:

a stationary portion configured to connect to the exhaust valve assembly and including a top and first threads; and a moveable portion including second threads coupled to the first threads of the stationary portion and being moveably connected to the stationary portion via the coupled first and second threads and configured to receive one end of a spring, the moveable portion protruding from the top of the stationary portion and being configured to change a length of the spring and control the size of the exhaust port when moved, wherein the top of the stationary portion includes a plurality of indicia and the stationary portion is configured to connect to the exhaust valve assembly by screws.

2. An adjustable cap for controlling the size of an exhaust port of an exhaust valve assembly of an internal combustion engine, comprising:

a stationary portion configured to connect to the exhaust valve assembly and including a top and first threads; and a moveable portion including second threads coupled to the first threads of the stationary portion and being moveably connected to the stationary portion via the coupled first and second threads and configured to receive one end of a spring, the moveable portion protruding from the top of the stationary portion and being configured to change a length of the spring and control the size of the exhaust port when moved, wherein the stationary portion is configured to connect to the exhaust valve assembly by a clip.

3. An adjustable cap for controlling the size of an exhaust port of an exhaust valve assembly of an internal combustion engine, comprising:

a stationary portion configured to connect to the exhaust valve assembly and including a top and first threads; and a moveable portion including second threads coupled to the first threads of the stationary portion and being moveably connected to the stationary portion via the coupled first and second threads and configured to receive one end of a spring, the moveable portion protruding from the top of the stationary portion and being configured to change a length of the spring and control the size of the exhaust port when moved, wherein the top of the stationary portion includes a plurality of indicia, and wherein the moveable portion includes:

a designator configured to visually designate one of the plurality of indicia on the top of the stationary portion.

4. The adjustable cap of claim 3, wherein the designator includes a protrusion of the moveable portion.

5. The adjustable cap of claim 3, wherein the designator includes a window in the moveable portion.

6. An adjustable cap for an exhaust valve assembly, comprising:

a stationary portion configured to connect to the exhaust valve assembly and including a top; and a moveable portion moveably connected to the stationary portion and configured to receive one end of a spring, the moveable portion protruding from the top of the stationary portion and being configured to change a length of the spring when moved, wherein the stationary portion further includes:

a neck connected to the top and including threads configured to receive corresponding threads on the moveable portion.

7. The adjustable cap of claim 6, wherein the top of the stationary portion includes a plurality of indicia, and wherein the neck of the stationary portion includes a plurality of grooves configured to hold a protrusion on the moveable portion.

8. The adjustable cap of claim 7, wherein the plurality of grooves correspond to the plurality of indicia.

9. The adjustable cap of claim 7, wherein the protrusion on the moveable portion comprises a set screw.

10. An adjustable cap for an exhaust valve assembly of an internal combustion engine, comprising:

a base configured to connect to the exhaust valve assembly; and a knob rotatably connected to the base and configured to receive one end of a spring and change a compression of the spring among a plurality of different compressions, at least one of the base or the knob including a plurality of positional marks, and wherein the knob is configured to change the compression of the spring among the plurality of different compressions when rotated among the plurality of positional marks and wherein the knob includes a pointer configured to point at one of the plurality of positional marks, and wherein the knob includes a handle at an end opposite the pointer.

11. The adjustable cap of claim 10, wherein the knob includes a cup for receiving the one end of the spring.

12. An adjustable cap for an exhaust valve assembly of an internal combustion engine, comprising:

a base configured to connect to the exhaust valve assembly; and a knob rotatably connected to the base and configured to receive one end of a spring and change a compression of the spring among a plurality of different compressions, wherein the knob is substantially circular and includes a plurality of indentations for gripping the knob, at least one of the base or the knob including a plurality of positional marks, and wherein the knob is configured to change the compression of the spring among the plurality of different compressions when rotated among the plurality of positional marks and wherein the knob includes a window configured to show one of the plurality of positional marks.

13. An adjustable cap for an exhaust valve assembly of an internal combustion engine, comprising:

a base configured to connect to the exhaust valve assembly; and a knob rotatably connected to the base and configured to receive one end of a spring and change a compression of the spring among a plurality of different compressions, at least one of the base or the knob including a plurality of positional marks, and wherein the knob is configured to change the compression of the spring among the plurality of different compressions when rotated among the plurality of positional marks and wherein the knob includes a pointer configured to point at one of the plurality of positional marks, wherein the base includes first threads, and wherein the knob includes second threads configured to engage the first threads to transform rotation of the knob to linear movement of the knob relative to the base.

14. An adjustable cap for an exhaust valve assembly of an internal combustion engine, comprising:

a base configured to connect to the exhaust valve assembly, the base including first threads; and a knob rotatably connected to the base and configured to receive one end of a spring and change a compression of the spring among a plurality of different compressions, at least one of the base or the knob including a plurality of positional marks, and wherein the knob is configured to change the compression of the spring among the plurality of different compressions when rotated among the plurality of positional marks and wherein the base includes a plurality of indentations that correspond to the plurality of positional marks and that are each configured to receive a protruding portion of the knob to hold the knob at one of a plurality of different positions and the spring at one of the plurality of different compressions, and wherein the knob includes second threads configured to engage the first threads to transform rotation of the knob to linear movement of the knob relative to the base.

15. An adjustable cap for an exhaust valve assembly of an internal combustion engine, comprising:

a base configured to connect to the exhaust valve assembly, the base including a plurality of positional marks, the base including first threads; and a knob rotatably connected to the base and configured to receive one end of a spring and change a compression of the spring among a plurality of different compressions, wherein the knob is configured to change the compression of the spring among the plurality of different compressions when rotated among the plurality of positional marks, the plurality of positional marks comprising an integer scale including a central value, and wherein the knob includes second threads configured to engage the first threads to transform rotation of the knob to linear movement of the knob relative to the base.

16. An exhaust valve assembly, comprising:

a diaphragm connected to a restricting member and configured to change a position of the restricting member based on a pressure on a first side of the diaphragm;

a spring abutting a second side of the diaphragm opposite the first side and applying a force to the second side of the diaphragm; and an adjustable portion adjacent the spring and configured to change the force applied to the diaphragm by the spring, wherein the adjustable portion includes indicia to visually indicate a plurality of different settings of the adjustable portion.

17. The exhaust valve assembly of claim 16, further comprising:

a casing enclosing at least the first side of the diaphragm.

18. The exhaust valve assembly of claim 16, wherein the adjustable portion is externally hand-adjustable by a user.

19. The exhaust valve assembly of claim 16, wherein the adjustable portion is adjustable to produce a plurality of different and repeatable forces applied to the diaphragm by the spring.

20. The exhaust valve assembly of claim 16, wherein the adjustable portion is configured to change a length of the spring by an amount up to about 0.3 inches.

21. An engine, comprising:

a cylinder structure including an inside wall that defines a cylinder bore with an exhaust port;

a piston that is movable in the cylinder bore and is adapted to open and close the exhaust port;

a restricting member mounted in the cylinder structure adjacent the exhaust port and adjustable between a more restricting position that decreases an area of the exhaust port and a less restricting position that increases an area of the exhaust port; and an assembly configured to move the restricting member between the more restricting position and the less restricting position, the assembly being externally adjustable by hand to vary a biasing force on the restricting member, wherein the assembly includes indicia to visually indicate a plurality of different settings associated with the biasing force.

22. The engine of claim 21, wherein the assembly is configured to move the restricting member to the less restricting position when a pressure on a portion of the assembly from the cylinder bore overcomes the biasing force.

23. The engine of claim 21, wherein the assembly is configured to produce at least five different biasing forces on the restricting member.

24. An apparatus, comprising:

a first means for coupling to a portion of an exhaust valve assembly, the exhaust valve assembly including:

a diaphragm connected to a restricting member and configured to change a position of the restricting member based on a pressure on a first side of the diaphragm, and a spring abutting a second side of the diaphragm opposite the first side and applying a force to the second side of the diaphragm; and a second means for rapidly adjusting a compression force on the spring, the second means including indicia to visually indicate a plurality of different settings associated with the compression force on the spring.

25. An apparatus for use with a two-stroke engine, the two-stroke engine including an exhaust valve and a spring used to control at least one aspect associated with the exhaust valve, the apparatus comprising:

a cap configured to attach to a portion of the two-stroke engine, the cap including a hand-adjustable portion configured to adjust a compression force on the spring, the hand-adjustable portion being operable to adjust the compression force on the spring without requiring use of a tool.

* * * * *